United States Patent [19]

Filhol et al.

[11] Patent Number: 4,815,625

[45] Date of Patent: Mar. 28, 1989

[54] PACKAGING SYSTEM

[76] Inventors: Stuart J. Filhol, Castlefreke, County Cork; Oliver St. Clair Hood, 61 Wellington Road, Ballsbridge, Dublin 4, both of Ireland

[21] Appl. No.: 129,898

[22] Filed: Dec. 7, 1987

Related U.S. Application Data

[63] Continuation of Ser. No. 879,056, Jun. 26, 1986, abandoned.

[30] Foreign Application Priority Data

Jun. 29, 1985 [GB] United Kingdom ..... 8516527

[51] Int. Cl.[4] ..... B65D 21/02; B65D 85/20

[52] U.S. Cl. ..... 220/23.4; 206/443; 220/4 B; 422/102; 446/125

[58] Field of Search ..... 220/23.4, 23.8, 23.83, 220/23.86, 4 B, 4 E; 206/443, 820; 422/102, 104; 446/125

[56] References Cited

U.S. PATENT DOCUMENTS

| | | | |
|---|---|---|---|
| 3,521,785 | 7/1970 | Bergmann | 220/23.4 |
| 3,538,962 | 11/1970 | Gibson | 220/23.4 |
| 4,240,547 | 12/1980 | Taylor | 220/4 E |
| 4,472,357 | 9/1984 | Levy | 220/23.4 |

FOREIGN PATENT DOCUMENTS

| | | | |
|---|---|---|---|
| 205911 | 12/1959 | Austria | 220/23.4 |
| 2308537 | 9/1974 | Fed. Rep. of Germany | 206/820 |
| 2822134 | 11/1979 | Fed. Rep. of Germany | 206/443 |
| 2029802 | 3/1980 | United Kingdom | 206/821 |

*Primary Examiner*—George E. Lowrance
*Attorney, Agent, or Firm*—Gifford, Groh, Sheridan, Sprinkle and Dolgorukov

[57] ABSTRACT

A system of packaging provides two or more interconnected containers A, B, C in which articles are retained and the containers can be separated from one another to gain access to the articles.

The packaging is assembled from elements each including a male and female tubular member 10 and 11 interconnected by frangible connecting means 22. Male members are engaged with female members to assemble a chain of containers which pivot relative to one another.

Separation of the connecting means to release a container enables the members 10 and 11 to be twisted relative to one another to gain access to the article.

8 Claims, 3 Drawing Sheets

PACKAGING SYSTEM

This is a continuation of co-pending application Ser. No. 879,056 filed on June 26, 1986.

This invention relates to packaging systems and in particular to a system of packaging which provides two or more interconnected containers which are closed to retain articles in the containers and which can be separated and opened to remove the articles.

According to the invention a packaging system comprises two or more interconnectable elements, the elements each including first and second tubular members extending parallel and side by side one another, the members being joined by separable connecting means, the system being made up by engaging an open end of the first tubular member of one element with an open end of the second tubular member of another element, whereby the interior of the cooperating tubular members of the two elements define a closed container.

Preferably the connecting means is frangible.

The first tubular member may be a male tubular member and the second tubular member is a female tubular member and engagement of the tubular members is by insertion of the open end of the male tubular member into the open end of the female tubular member.

Conveniently said open ends of the first and second tubular members define interengaging locking means for inhibiting separation of the members after assembly.

The assembled first and second members may be pivotable relative to adjacent assembled second and first members by relative rotation between the first and second members of different elements.

The locking means may include an externally-located catch on one member and an internally-located portion, engageable with the catch, on the other member, the catch, when th elements are assembled, preventing release of one member from the other.

Conveniently the locking means is located over circumferential portions of the members and the catch extends partly around the associated member so that, upon pivoting of a first member relative to its cooperating second member, the catch can be disengaged from the internally-located portion to enable access to be gained to the container.

Preferably the relative pivoting action of the members to the release position is only possible when the connecting means between adjacent cooperating members of an element is separated.

The first and second tubular members may each be of generally cylindrical shape having a longitudinal, circular-section opening extending from the open end to define the interior of the member.

Preferably the second member includes an extension of circular shape in which the open end of the first member is received.

In order to form the packaging system as a chain of interconnected but separable containers the first tubular member of one element is engaged with the second tubular member of another element and the second tubular member of said one element is engaged with the first tubular member of a third element.

It will be seen that a chain of containers each comprising first and second members can be separated into individual containers by separating at the conecting means whereupon the container may be opened to gain access to an article or articles in the container.

Further features of the invention will appear from the following description of embodiments of the invention given by way of example only and with reference to the drawings, in which.

Figure 2:
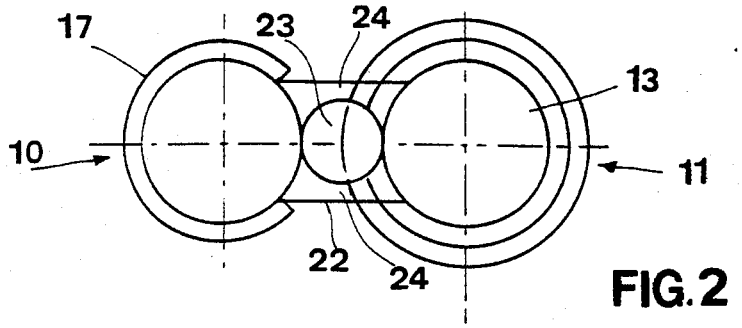
FIG. 2 is an end view from above.
Figure 1:
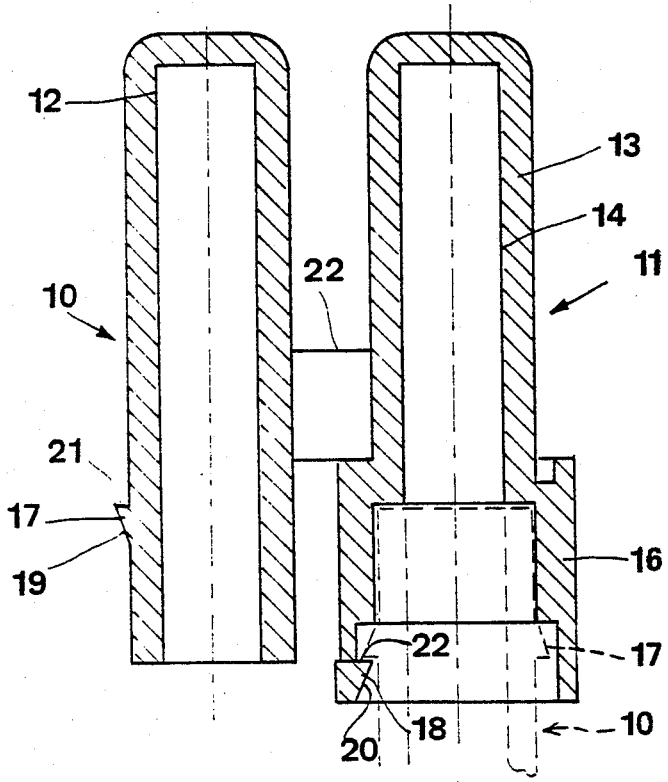
FIG. 1 is a side elevation of packaging element in vertical section.
Figure 3:
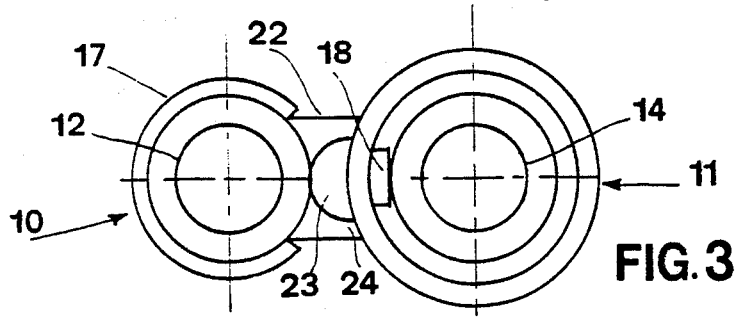
FIG. 3 is an end view from below.

Referring to the drawings a packaging system is made up of a plurality of packaging elements such as shown in FIGS. 1–3. Each element includes a male member 10 and a female member 11.

The male member 10 is generally cylindrical having a circular opening 12 from one end, the other end being closed.

The female member 11 has a generally cylindrical portion 13 with a circular opening 14 also closed at one end. The open ends of the members 10 and 11 face in the same direction.

The female member 11 is provided with an extension 16 from its open end which is generally cylindrical but of larger diameter than the portion 13. The interior of the extension 16 is sized to receive the open end of a male member 10 of a further similar element to that shown, as will be described.

On the external surface of the male member 10 towards its open end is formed a circumferential lip or catch member 17 which extends partially around the member 10, as best seen in FIGS. 2 and 3. On the internal surface of the extension 16 is formed a cooperating lip or catch member 18. The catch members 17 and 18 have inclined surfaces 19 and 20 and surfaces 21 and 22 at right angles to the associated walls so that, when the male member 10 of one element is inserted into the extension 16 of the female member 11, to catch members 17 and 18 secure the elements together by interengagement of the surfaces 21 and 22. As will be described the two members 10 and 11 can only be separated by rotating one relative to the other until the catch member 18 is clear of the circumferentially-extending catch member 17.

The members 10 and 11 of each element are interconnected by connecting means 22 which is preferably integral with the members 10 and 11 and is formed with a central circular opening 23 to thereby form narrow neck portions 24. The connecting means 22 is formed of a material such that the neck portions 24 can be broken by manually twisting or bending one member relative to the other.

Figure 4:
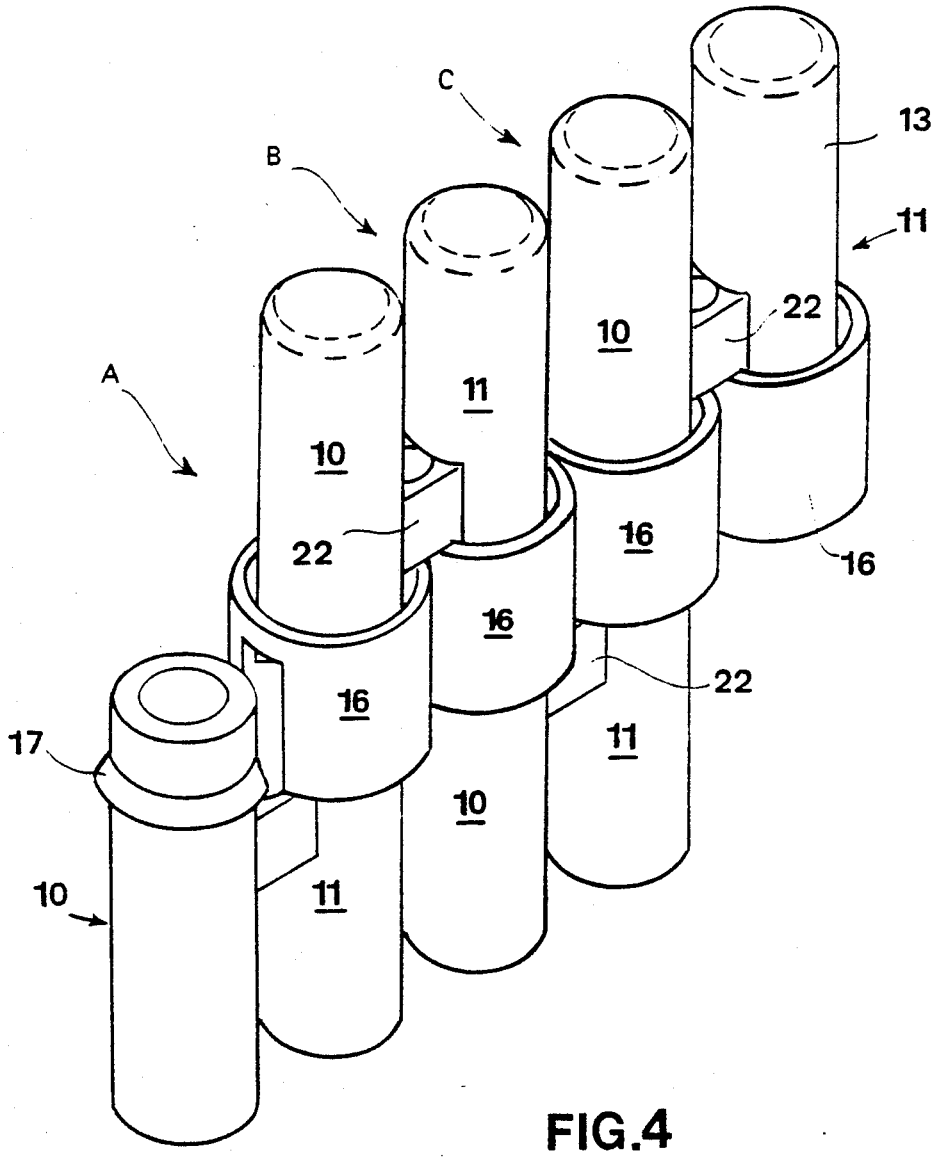
FIG. 4 is a perspective view of a plurality of interconnected elements.

To assemble elements such as shown in FIGS. 1–3 into the chain shown in FIG. 4, the male member 10 of one element is inserted into the female member 11 of another element. Similarly the male member of a third element is inserted into the female member of said one element. A chain of many elements can thus be assembled. As shown in FIG. 4 a chain of four elements is assembled to define three containers A, B and C, the male and female members of the end elements being redundant.

It will be seen that the adjacent containers can be rotated a limited extent relative to one another about the join between the male and female members but, as shown, the extent of rotation is limited and insufficient to enable the release of one member from the other in each of the assembled containers. It if is required to gain access to articles placed within the containers the end container in the chain must be broken off at the connecting means 22 whereupon one member 10 or 11 of the container is now capable of being rotated relative to the other sufficiently to disengage the catch members 17 and 18 and separate the members 10 and 11. However, if desired, the circumferential extent of the catch 17 can be reduced and separation of the members can be achieved without breaking off the containers one from the other.

The assembled elements define a flexible chain of containers which may be located in a dispenser (not shown) so that one or more containers can be exposed and can be disconnected from the others.

The elements are conveniently made of plastics material and each element is formed as an integral plastics moulding.

Instead of the connecting means 22 being in the form shown in FIGS. 1–4 it may take other forms in which a connection is achieved by which the containers A, B, C are easily separated preferably, but not exclusively, by manual manipulation of one container relative to an adjacent container. Thus, for example, as shown in FIGS. 5 and 6, the connecting means 22 may take the form of a relatively thin strip integrally formed with the elements 10 and 11 and having notches 30 at opposite side edges to define a breaking-off point.

Figure 5:
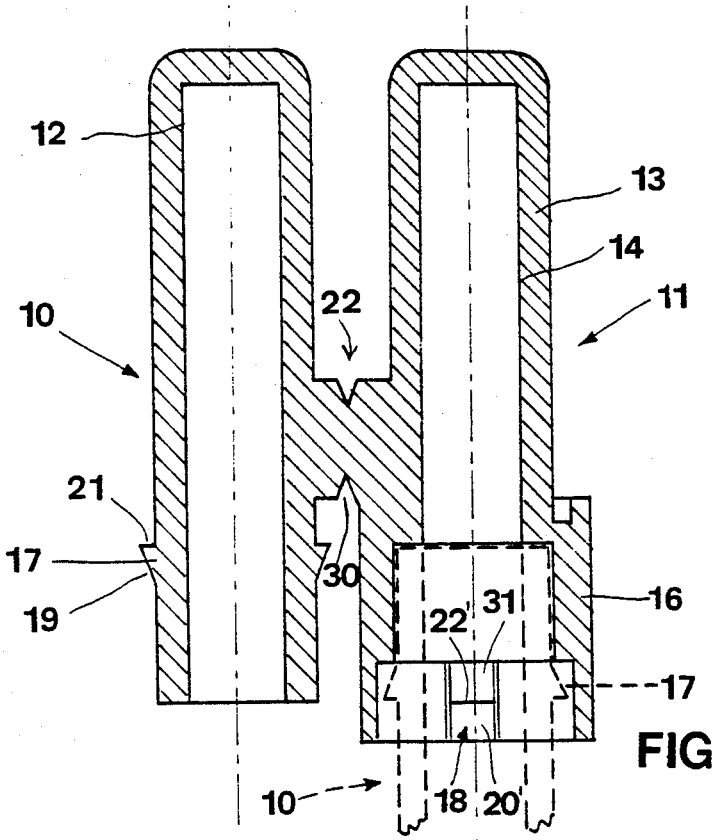
FIG. 5 is a section, corresponding to FIG. 1, of another embodiment.
Figure 6:
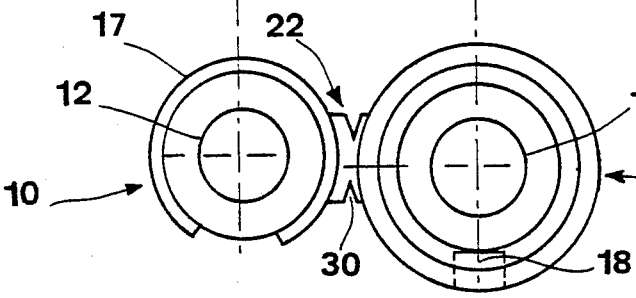
FIG. 6 is an end view, corresponding to FIG. 3, of the embodiment of FIG. 5.

Moreover, also as shown in FIGS. 5 and 6, the catch member 18 may be formed on a resilient tongue 31 integrally connected with the female element 11 at one end and having inclined surfaces 18' and 22' corresponding to the surfaces 18 and 22 of the FIGS. 1–4 embodiment. A catch member 17, similar to that of the FIGS. 1–4 embodiment, is formed as the male element 10 to cooperate with the catch member 18 on the tongue 31 when the elements are assembled. In this case the catch member 17 extends circumferentially of the element 10 to leave a gap over a different portion of the element to obtain release of the elements when a container is disconnected and the two elements 10 and 11 of the container are relatively rotated. In this way the elements are separated by the catch member 18 passing through the gap in the catch member 17, as before.

What we claim as our invention and desire to secure by Letters Patent of the United States is:

1. A packaging system which comprises two or more interconnectable elements, the elements each including first and second tubular members extending parallel and side by side one another, the first and second members of each element being joined by separable frangible connecting means, said first and second member each having an open end, the elements being assembled to one another by locating said open end of the first tubular member of one element into said open end of the second tubular member of another element to secure the elements together, the cooperating first and second tubular members thus assembled defining a closed container which is separable from adjacent tubular members by separation of said connecting means and the tubular members of each container being separable from each other whenever one tubular member includes an enlarged diameter portion adjacent its said open end adapted to receive the open end of the other tubular member, and wherein said members include integral locking means for inhibiting separation of the members after assembly and after breaking of the frangible connecting means, at least a portion of said locking means being contained in said enlarged diameter portion.

2. A system according to claim 1 wherein the elements are each of plastics, one piece, integral construction.

3. A system according to claim 1 wherein the assembled first and second members are pivotable relative to adjacent assembled first and second members by relative rotation between the first and second members of different elements.

4. A system according to claim 1 wherein the locking means includes an externally located catch on one member and an internally located portion, engageable with the catch, on the other member, the catch, when the elements are assembled, preventing release of one member from the other.

5. A system according to claim 4 wherein the locking means is located over circumferential portions of the members and the catch extends partly around its associated member so that, upon pivoting of a first member relative to its cooperating second member, the catch can be disengaged from the internally located portion to enable access to be gained to the container.

6. A system according to claim 5 wherein the relative pivoting action of the members to a release position is only possible when the connecting means between adjacent cooperating members of an element is separated.

7. A system according to claim 1 wherein the first and second tubular members are each of generally cylindrical shape having a longitudinal, circular cross-section opening extending from the open end to define the interior of the member.

8. A system according to claim 1 including a chain of interconnected but separable containers wherein the first tubular member of one element is engaged with the second tubular member of another element, and the second tubular member of said one element is engaged with the first tubular member of a third element.

* * * * *